US010299640B2

(12) United States Patent
Rokuta et al.

(10) Patent No.: US 10,299,640 B2
(45) Date of Patent: May 28, 2019

(54) SANITARY WASHING APPARATUS

(71) Applicant: TOTO LTD., Kitakyushu-shi, Fukuoka (JP)

(72) Inventors: Tomomi Rokuta, Fukuoka (JP); Akihiro Ashihara, Fukuoka (JP); Yukari Kawazu, Fukuoka (JP); Tomoaki Suetsugu, Fukuoka (JP); Masayuki Mochita, Fukuoka (JP)

(73) Assignee: TOTO LTD., Kitakyushu-shi (JP)

( * ) Notice: Subject to any disclaimer, the term of this patent is extended or adjusted under 35 U.S.C. 154(b) by 0 days.

(21) Appl. No.: 15/672,463

(22) Filed: Aug. 9, 2017

(65) Prior Publication Data

US 2018/0049606 A1 Feb. 22, 2018

(30) Foreign Application Priority Data

Aug. 17, 2016 (JP) ..... 2016-160201

(51) Int. Cl.

| | |
|---|---|
| ***E03C 1/042*** | (2006.01) |
| ***A47K 13/26*** | (2006.01) |
| ***E03D 9/08*** | (2006.01) |
| ***E03D 11/13*** | (2006.01) |

(52) U.S. Cl.
CPC ..... *A47K 13/26* (2013.01); *E03D 9/08* (2013.01); *E03D 11/13* (2013.01)

(58) Field of Classification Search
CPC ..... A47K 13/26; E03D 9/08
USPC ..... 4/695
See application file for complete search history.

(56) References Cited

U.S. PATENT DOCUMENTS

2004/0068785 A1 4/2004 Tomita et al.
2006/0218710 A1* 10/2006 Furukawa ..... A47K 13/12 4/237

FOREIGN PATENT DOCUMENTS

| | | |
|---|---|---|
| CN | 203970265 | 12/2014 |
| EP | 2993273 | 3/2016 |
| JP | 2000-116570 | 4/2000 |
| JP | 2010-031470 | 2/2010 |

OTHER PUBLICATIONS

Extended European Search Report for European Patent Application No. 17186458.0 dated Jan. 19, 2018.

* cited by examiner

*Primary Examiner* — Huyen Le
(74) *Attorney, Agent, or Firm* — Amin, Turocy & Watson LLP

(57) ABSTRACT

A sanitary washing apparatus according to an embodiment includes a base plate and a body part. The base plate has a pair of mounting holes that corresponds to a pair of through-holes formed on an upper surface of a toilet bowl and is mounted on the upper surface of the toilet bowl by inserting fastening members mounted on the pair of mounting holes through the pair of through-holes. The body part incorporates a functional component that includes a washing nozzle, and is mounted on the toilet bowl via the base plate. Furthermore, a mounting part for the body part is formed only between the pair of mounting holes on the base plate.

7 Claims, 10 Drawing Sheets

SANITARY WASHING APPARATUS

CROSS-REFERENCE TO RELATED APPLICATION

The present application claims priority to and incorporates by reference the entire contents of Japanese Patent Application No. 2016-160201 filed in Japan on Aug. 17, 2016.

FIELD

A disclosed embodiment relates to a sanitary washing apparatus.

BACKGROUND

In recent years, it has been proposed that a water supply hose or an electrical power supply cord that is connected to a sanitary washing apparatus is hidden in order to improve a design of a toilet space.

Specifically, it has been proposed that a through-hole is provided on an upper surface of a toilet bowl and a water supply hose or an electrical power supply cord passes through such a through-hole and is drawn from a back side of a toilet bowl, so that it is not possible to view the water supply hose or the electrical power supply cord from an outside thereof. A pair of through-holes (that will be described as first through-holes, below) for mounting a sanitary washing apparatus is formed on an upper surface of a toilet bowl, and a through-hole (that will be described as a second through-hole, below) for passing a water supply hose or an electrical power supply cord therethrough is formed around the pair of first through-holes.

Herein, Japanese Laid-open Patent Publication No. 2016-050468 discloses a configuration of a base plate for fixing a body part of a sanitary washing apparatus on a toilet bowl provided with a second though-hole. Specifically, a base plate as described in Japanese Laid-open Patent Publication No. 2016-050468 has a pair of mounting holes for fixing the base plate on a toilet bowl at a position that corresponds to a pair of first through-holes of the toilet bowl. Furthermore, a base plate as described in Japanese Laid-open Patent Publication No. 2016-050468 has an insertion hole for inserting a water supply hose or an electrical power supply cord therethrough at a position that corresponds to a second through-hole of a toilet bowl.

Furthermore, a base plate as described in Japanese Laid-open Patent Publication No. 2016-050468 has a mounting part for mounting a body part of a sanitary washing apparatus on the base plate. Specifically, a base plate as described in Japanese Laid-open Patent Publication No. 2016-050468 has a hook-like groove that fits with a hook provided on a bottom of a body part or a linear groove that guides a linear protrusion provided on the bottom of the body part. Such a mounting part is formed around a pair of mounting holes similarly to an insertion hole.

However, there is room for further improvement in a base plate as described in a conventional technique as described above, in that a mounting part for mounting a body part is arranged near an insertion hole that is opened in order to insert a water supply hose or an electrical power supply cord therethrough, and hence, strength of mounting is secured.

SUMMARY

It is an object of the present invention to at least partially solve the problems in the conventional technology.

A sanitary washing apparatus according to an aspect of an embodiment includes a base plate and a body part. The base plate has a pair of mounting holes that corresponds to a pair of through-holes formed on an upper surface of a toilet bowl and is mounted on the upper surface of the toilet bowl by inserting fastening members mounted on the pair of mounting holes through the pair of through-holes. The body part incorporates a functional component that includes a washing nozzle, and is mounted on the toilet bowl via the base plate. Furthermore, a mounting part for the body part is formed only between the pair of mounting holes on the base plate.

BRIEF DESCRIPTION OF DRAWINGS

The above and other objects, features, advantages and technical and industrial significance of this invention will be better understood by reading the following detailed description of presently preferred embodiments of the invention, when considered in connection with the accompanying drawings.

DESCRIPTION OF EMBODIMENT

Hereinafter, an embodiment(s) of a sanitary washing apparatus as disclosed in the present application will be described in detail, with reference to the accompanying drawings. Herein, this invention is not limited by an embodiment(s) as illustrated below.

1. General Configuration of Sanitary Washing Apparatus

Figure 2A:
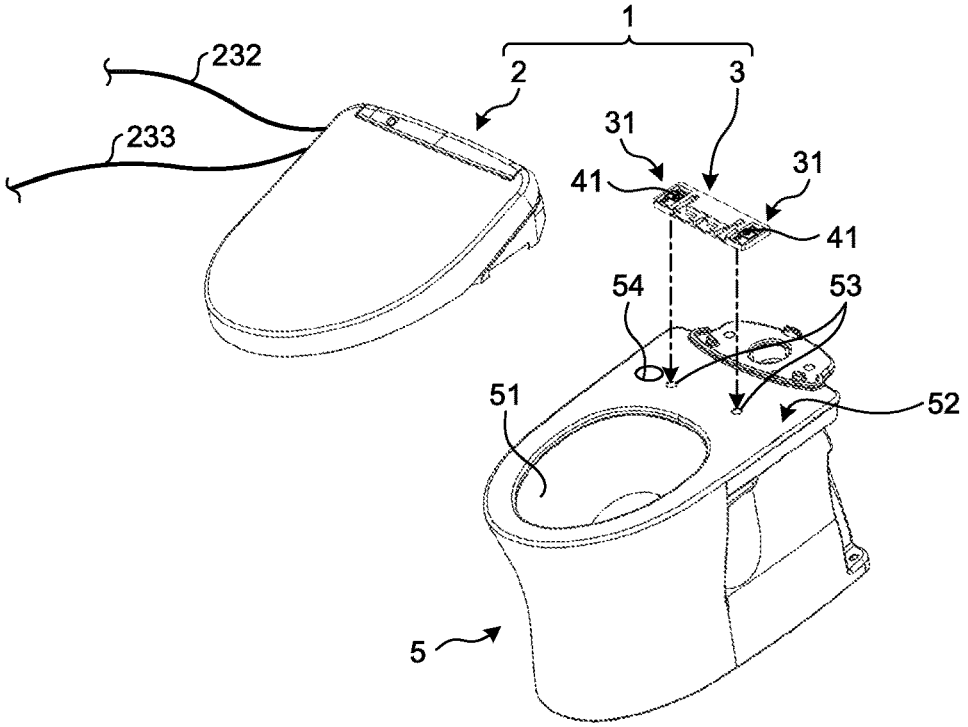
FIG. 2A is a schematic perspective view illustrating steps of mounting of a sanitary washing apparatus.
Figure 2B:
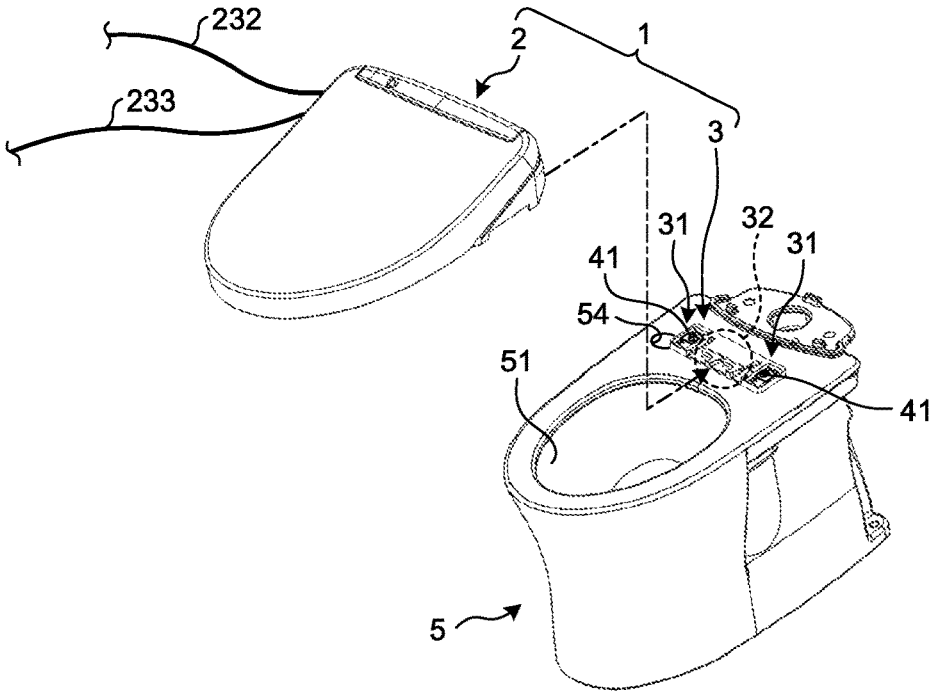
FIG. 2B is a schematic perspective view illustrating steps of mounting of a sanitary washing apparatus.
Figure 3:
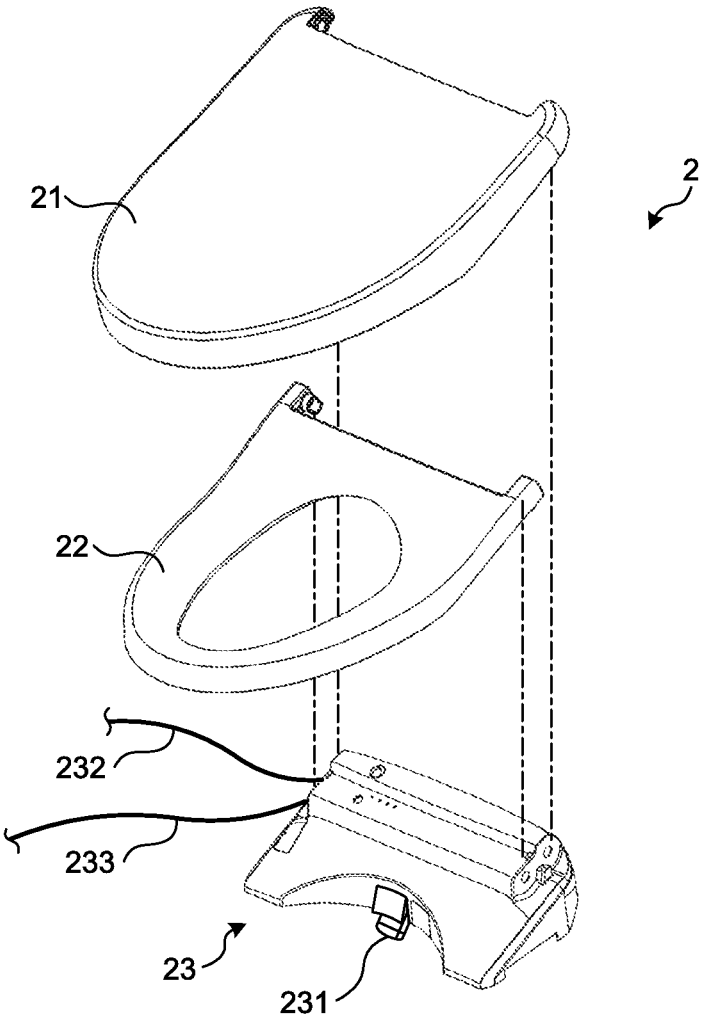
FIG. 3 is a schematic exploded perspective view of a body part of a sanitary washing apparatus.

First, a general configuration of a sanitary washing apparatus will be described with reference to FIG. 1 to FIG. 3.

Figure 1:
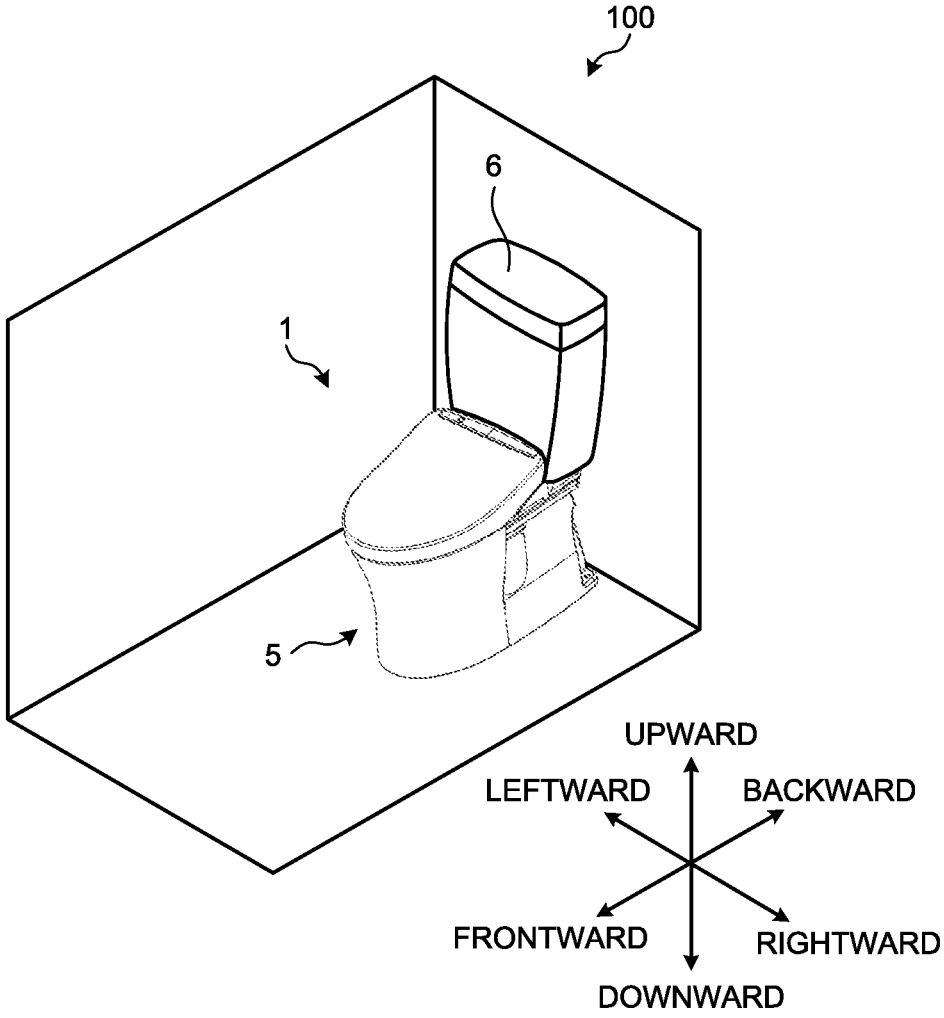
FIG. 1 is a schematic perspective view illustrating a toilet space where a sanitary washing apparatus according to an embodiment is placed.

FIG. 1 is a schematic perspective view illustrating a toilet space where a sanitary washing apparatus according to an embodiment is placed. FIG. 2A and FIG. 2B are schematic perspective views illustrating steps of mounting of a sanitary washing apparatus. FIG. 3 is a schematic exploded perspective view of a body part of a sanitary washing apparatus.

Additionally, in the present specification, a vertically upward direction and a vertically downward direction are described as "upward" and "downward", respectively. Furthermore, a front side, a back side, a right side, and a left side of a toilet bowl 5 when viewed from a user that faces the toilet bowl 5 are described as "frontward", "backward", "rightward", and "leftward", respectively.

As illustrated in FIG. 1, a sanitary washing apparatus 1 is provided on top of a toilet bowl 5 arranged in a toilet space 100. The toilet bowl 5 is a Western-style flush toilet bowl and a tank 6 is provided in back of the sanitary washing apparatus 1.

As illustrated in FIG. 2A, a pair of first through-holes 53, 53 and a second through-hole 54 are formed on an upper surface 52 of the toilet bowl 5 on a back side of a bowl part 51.

The pair of first through-holes 53, 53 is through-holes for mounting the sanitary washing apparatus 1 and is arranged side by side in leftward and rightward directions of the toilet bowl 5.

The second through-hole 54 is a through-hole for passing a water supply hose 232 and an electrical power supply cord 233 that are connected to the sanitary washing apparatus 1 therethrough, and is arranged around the pair of first through-holes 53, 53. Specifically, the second through-hole 54 is arranged, for example, on a left side of a first through-hole 53 on a left side among the pair of first through-holes 53, 53, and close to such a first through-hole 53. The second through-hole 54 has a diameter greater than that of the pair of first through-holes 53, 53.

The sanitary washing apparatus 1 includes a body part 2 and a base plate 3. As illustrated in FIG. 3, the body part 2 includes a toilet lid 21, a toilet seat 22, and a functional part 23. The toilet lid 21 and the toilet seat 22 are supported so as to be openable and closable around an axis of the functional part 23. The toilet seat 22 incorporates a non-illustrated heating part for warming buttocks of a user.

The functional part 23 incorporates a variety of functional components. For example, the functional part 23 incorporates a washing nozzle 231 as a functional component. The washing nozzle 231 moves into the bowl part 51 from an inside of the functional part 23 and discharges water toward a private part of a user, and thereby, washes the private part of the user.

Herein, the functional part 23 may incorporate, for example, a deodorization function part that sucks air in the bowl part 51 and reduces an odor component via a filter, a catalyst, or the like, a hot-air drying function that blows hot air toward buttocks or the like of a user, or the like, as a functional component other than the washing nozzle 231.

For example, the water supply hose 232 for supplying the sanitary washing apparatus 1 with water that is used for the washing nozzle 231, the electrical power supply cord 233 for executing electrical power supply for a variety of functional components that are incorporated in the functional part 23 or a non-illustrated heating part that is incorporated in the toilet seat 22 are connected to the functional part 23. The water supply hose 232 and the electrical power supply cord 233 are arranged, for example, on a left side of the functional part 23.

As illustrated in FIG. 2A and FIG. 2B, the base plate 3 has a pair of mounting holes 31, 31 for mounting the base plate 3 on the toilet bowl 5 and a mounting part 32 for mounting the body part 2 on the base plate 3. The pair of mounting holes 31, 31 is formed at a position that corresponds to the pair of first through-holes 53, 53 formed on the upper surface 52 of the toilet bowl 5, and the mounting part 32 is formed between the first through-holes 53, 53.

In a case where the sanitary washing apparatus 1 is mounted on the toilet bowl 5, first, the base plate 3 is mounted on the upper surface 52 of the toilet bowl 5. Specifically, fastening members such as bolts 41, 41 mounted on the pair of mounting holes 31, 31 of the base plate 3 are inserted through the first through-holes 53, 53, and the bolts 41, 41 are screwed by a screwdriver or the like, so that the base plate 3 is fastened and fixed on the toilet bowl 5. The base plate 3 is mounted on the upper surface 52 of the toilet bowl 5 in a state where a longitudinal direction thereof is directed to a leftward or rightward direction.

Subsequently, the water supply hose 232 and the electrical power supply cord 233 that are connected to the body part 2 pass through the second through-hole 54 of the toilet bowl 5 and is drawn from a back side of the toilet bowl 5. Thereby, the water supply hose 232 and the electrical power supply cord 233 are not readily viewed from an outside, and hence, it is possible to improve a design of a toilet space. The water supply hose 232 and the electrical power supply cord 233 are connected to a water supply source and an electrical power supply source, respectively.

Subsequently, the body part 2 is mounted on the base plate 3. Specifically, a non-illustrated part subjected to mounting that engages with the mounting part 32 of the base plate 3 is formed on a lower surface of the body part 2. Then, the body part 2 is horizontally slid from a front side to a back side of the base plate 3, and thereby, a part subjected to mounting of the body part 2 engages with the mounting part 32 of the base plate 3 to provide a state where the body part 2 is mounted on the base plate 3.

Thus, the body part 2 of the sanitary washing apparatus 1 is mounted on the toilet bowl 5 via the base plate 3 mounted on the upper surface 52 of the toilet bowl 5.

2. Configuration of Base Plate

Figure 4:
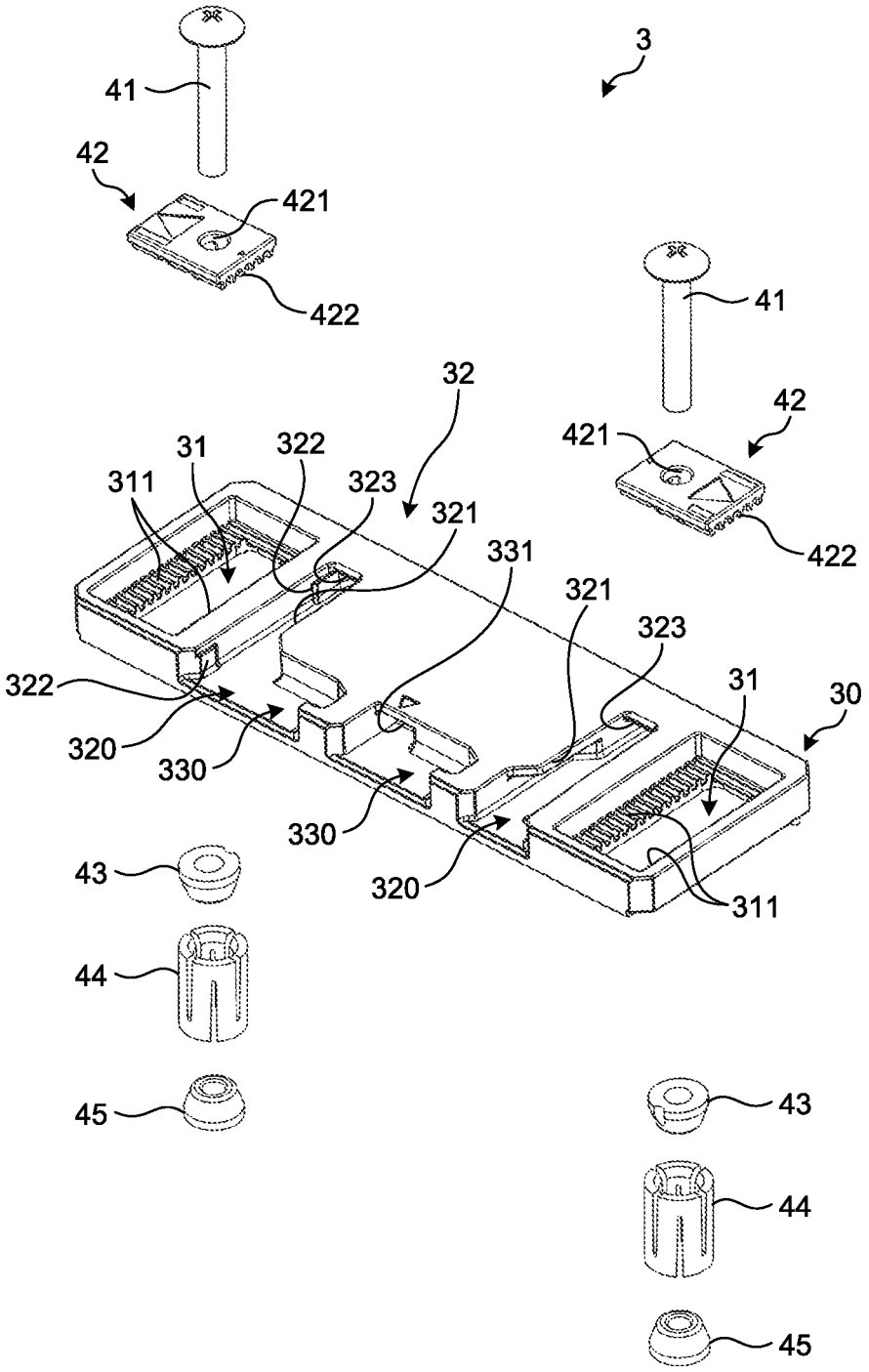
FIG. 4 is a schematic exploded perspective view of a base plate.

Next, a configuration of the base plate 3 according to an embodiment will be described with reference to FIG. 4. FIG. 4 is a schematic exploded perspective view of the base plate 3.

As illustrated in FIG. 4, the base plate 3 according to an embodiment includes a plate body 30 with a rectangular plate shape, a pair of bolts 41, 41, a pair of positioning plates 42, 42, a pair of first nuts 43, 43, a pair of bushes 44, 44, and a pair of second nuts 45, 45.

The plate body 30 has a pair of the mounting holes 31, 31 and the mounting part 32 that are described above. The plate body 30 is formed of, for example, a resin. A specific configuration of the plate body 30 will be described later.

The bolt 41 is a fastening member for fixing the plate body 30 on the toilet bowl 5. The bolt 41 is inserted through the mounting hole 31 from above the plate body 30 via the positioning plate 42.

The positioning plate 42 has a rectangular plate shape that is longitudinal in leftward and rightward directions and has an insertion hole 421 where the bolt 41 is inserted therethrough, and a number of grooves 422 that engage with a groove 311 formed on the plate body 30. The grooves 422 are formed on a lower surface of the positioning plate 42 and extend in leftward and rightward directions. The insertion hole 421 is formed at a position shifted from a center of the positioning plate 42, where such a point will be described later. Herein, the positioning plate 42 is formed of, for example, a resin.

The first nuts 43, 43, the bushes 44, 44, and the second nuts 45, 45 are fastening members for fixing the plate body 30 on the toilet bowl 5 and mounted on the bolts 41, 41 inserted through the mounting hole 31 from below the plate body 30. The first nut, the bush 44, and the second nut 45 are formed of, for example, a rubber.

The bolts 41, 41, the first nuts 43, 43, the bushes 44, 44, and the second nuts 45, 45 that are mounted on the pair of mounting holes 31, 31 are inserted through the pair of first through-holes 53, 53 of the toilet bowl 5, and the bolts 41, 41 are screwed by using a screwdriver or the like. Accordingly, the first nuts 43, 43 and the second nuts 45, 45 are pushed into the bushes 44, 44, so that the bushes 44, 44 expand in the first through-holes 53, 53, plug the first through-holes 53, 53, and fix the plate body 30. Thus, the base plate 3 is mounted on an upper surface of the toilet bowl 5.

Figure 5:
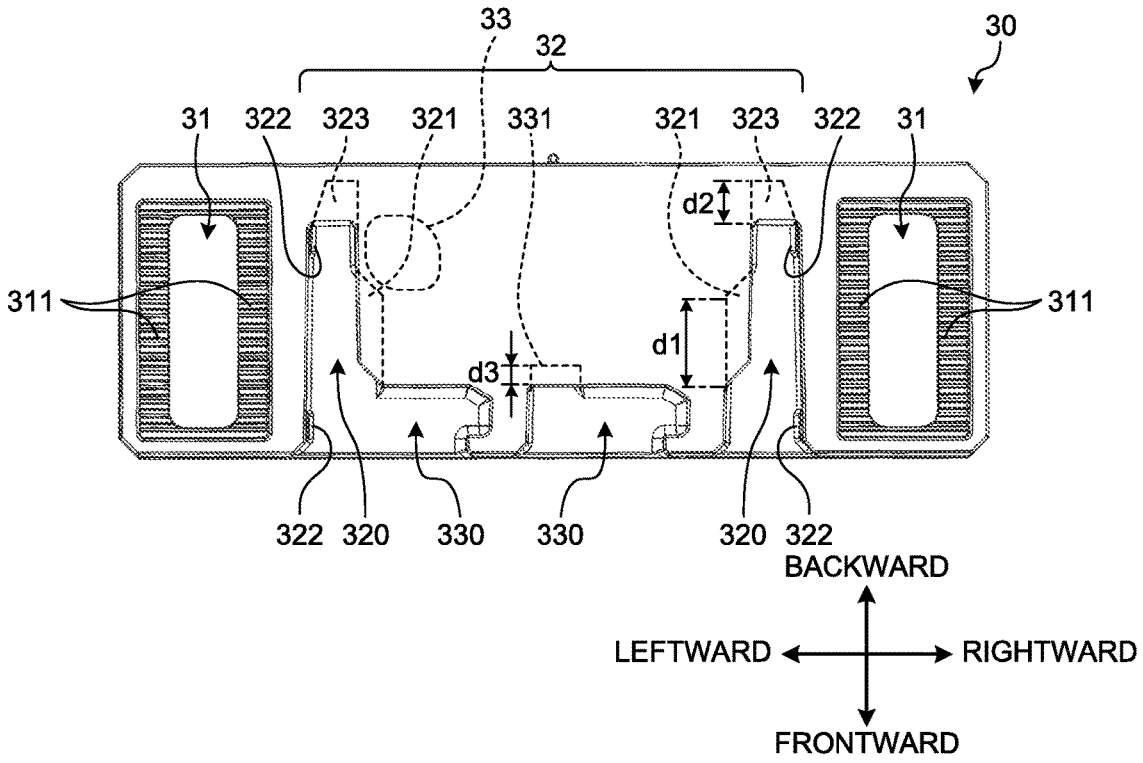
FIG. 5 is a schematic plan view of a plate body.

Next, a specific configuration of the plate body 30 will be described with reference to FIG. 5 and FIG. 6. FIG. 5 is a schematic plan view of the plate body 30. Furthermore, FIG. 6 is a schematic plan view illustrating a state where the base plate 3 is mounted on the toilet bowl 5.

As illustrated inn FIG. 5, the pair of mounting holes 31, 31 is long holes that extend in forward and backward directions and is formed at both edge parts of the plate body 30 in a longitudinal direction.

Step parts that are lower than an upper surface of the plate body 30 by one step are formed around outer edges of the pair of mounting holes 31, 31, and a number of grooves 311 that extend in leftward and rightward directions of the toilet bowl 5 are formed on such step parts. The grooves 311 engage with the grooves 422 of the positioning plate 42.

Figure 6:
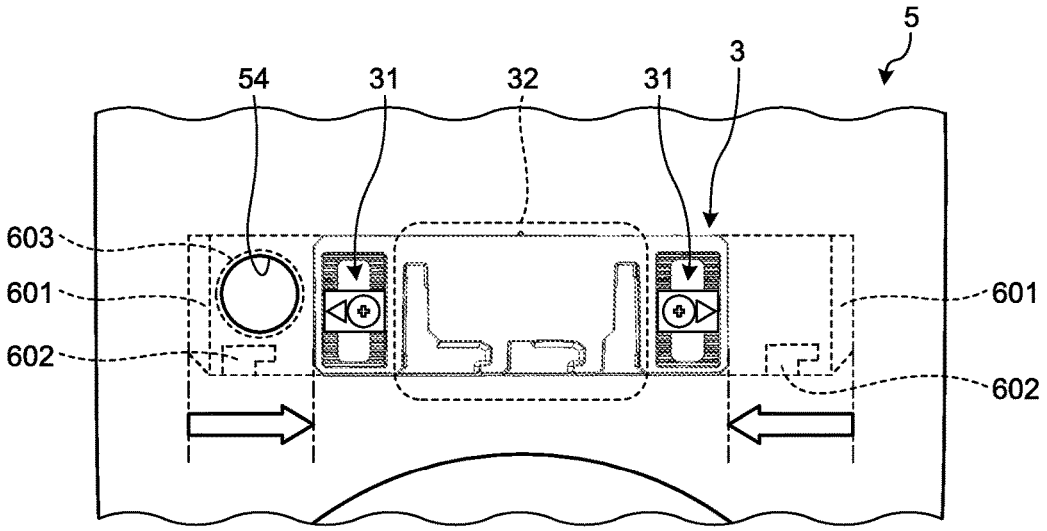
FIG. 6 is a schematic plan view illustrating a state where a base plate is mounted on a toilet bowl.

As illustrated in FIG. 6, a conventional base plate is provided with a mounting part for a body in a region around a pair of mounting holes. For example, on a conventional base plate, linear grooves 601, 601 that guide linear protrusions provided on a bottom of a body part or hook-like grooves 602, 602 that engage with hooks provided on the bottom of the body part are formed around a pair of mounting holes.

On the other hand, the mounting part 32 for the body part 2 is formed only between the pair of mounting holes 31, 31 on the base plate 3 according to an embodiment. Thereby, it is possible to provide a length of the plate body 30 in a longitudinal direction (leftward and rightward directions of the toilet bowl 5) that is less than that of conventional one. Therefore, in a case where the second through-hole 54 for passing the water supply hose 232 or the electrical power supply cord 233 therethrough is formed, it is possible to pass the water supply hose 232 or the electrical power supply cord 233 through the second through-hole 54 without plugging the second through-hole 54. Furthermore, it is possible to secure strength of mounting on the toilet bowl 5, as compared with a conventional base plate where mounting parts such as the linear grooves 601, 601 or the hook-like grooves 602, 602 are formed close to an insertion hole 603.

By returning to FIG. 5, a specific configuration of the mounting part 32 will be described. As illustrated in FIG. 5, the mounting part 32 has a pair of linear grooves 320, 320 that extend in mounting directions (namely, leftward and rightward directions) of the body part 2, and a pair of hook-like grooves 330, 330 that extend in directions orthogonal to the mounting directions (namely, leftward and rightward directions) of the body part 2.

The pair of linear grooves 320, 320 and the pair of hook-like grooves 330, 330 are groove parts that are opened on a front side (namely, a front side in mounting directions) of the plate body 30 and upward, and the pair of hook-like grooves 330, 330 is formed between the pair of linear grooves 320, 320. Herein, one of the pair of hook-like grooves 330, 330 (herein, the hook-like groove 330 on a left side) is formed integrally with one of the pair of linear grooves 320, 320 (herein, the linear groove 320 on a left side). Thereby, it is possible to form the mounting part 32 to be more compact.

A first engagement recess 321 and a plurality of press fit protrusions 322 are formed on a side surface of each linear groove 320. The first engagement recess 321 is a recess that opens on a front side of the plate body 30 (namely, a front side in mounting directions) and a side of the linear groove 320 and is plugged on an upper side thereof. The press fir protrusion 322 is provided on a side surface of the linear groove 320.

The first engagement recess 321 is provided on a back side (namely, a back side in mounting directions) of an edge of the linear groove 320 on a front side (namely, a front side in the mounting directions). In other words, a notch that opens on an upper side is formed on a front side of the first engagement recess 321. According to such a configuration, it is possible to reduce an amount of sliding of the body part 2 as compared with a case where a notch is not provided, and hence, it is possible to reduce an effort needed for attachment or detachment of the body part 2. Herein, a length d1 of the first engagement recess 321 in forward and backward directions (namely, mounting directions) is set at, for example, 20 mm or greater, by taking into consideration the first engagement recess 321 being a part that mainly receives force applied to the body part 2.

On the base plate 3 according to an embodiment, the first engagement recess 321 is provided on a side surface of the base plate 3 on a center side (namely, a side of the hook-like groove 330) among both left and right side surfaces of the linear groove 320, and the press fit protrusion 322 is provided on a side surface thereof on an outer side (namely, a side of the mounting hole 31). Thereby, it is possible to form the mounting part 32 to be compact, as compared with a case where arrangement of the first engagement recess 321 and the press fit protrusion 322 is reversed, and it is possible for the mounting part 32 to be appropriately collective in a region between the pair of mounting holes 31, 31.

Furthermore, second engagement recesses 323, 323 that open toward a front side of the plate body 30 (namely, a front side in mounting directions) and are plugged on an upper side thereof are provided on surfaces of the pair of linear grooves 320, 320 on a back side (namely, a back side in mounting directions). The second engagement recesses 323, 323 are formed on a back side of the plate body 30 (a back side in mounting directions) with respect to a center of the plate body 30.

Furthermore, a third engagement recess 331 that opens toward a front side of the plate body 30 and is plugged on an upper side thereof is provided on a surface of one hook-like groove 330 (herein, the hook-like groove 330 on a right side) among the pair of hook-like grooves 330, 330 on a back side (namely, a back side in mounting directions). The third engagement recess 331 is formed on a front side of the plate body 30 (a front side in mounting directions) with respect to a center of the plate body 30.

Thus, the third engagement recess 331 is provided on a surface of one hook-like groove 330 among the pair of hook-like grooves 330, 330 on a back side in mounting directions, and hence, it is possible to form the mounting part 32 to be more compact, as compared with a case where the third engagement recess 331 and the pair of hook-like grooves 330, 330 are independently provided at different locations. Therefore, it is possible for the mounting part 32 to be appropriately collective in a region between the pair of mounting holes 31, 31.

Lengths d2, d3 of the second engagement recess 323 and the third engagement recess 331 in frontward and backward directions (namely, mounting directions) are set to be less than a length d1 of the first engagement recess 321 in the frontward and backward directions (namely, the mounting directions). For example, lengths d2, d3 of the second engagement recess 323 and the third engagement recess 331 are set at 20 mm or less. Thus, while a length d1 of the first engagement recess 321 that mainly receives force applied to the body part 2 is set to be greatest so that strength of mounting is secured, lengths d2, 3 of the second engagement recess 323 and the third engagement recess 331 are set to be less than that of the first engagement recess 321 so that it is possible to prevent an amount of a stroke in a case of attachment or detachment of the body part 2 from being increased.

Furthermore, as illustrated in FIG. 5, a magnet 33 as an opening or closing detection sensor that detects opening or closing of the toilet lid 21 is incorporated between the pair of the mounting holes 31, 31 of the plate body 30. More specifically, the magnet 33 is incorporated between the pair of linear grooves 320, 320.

3. Configuration of Part Subjected to Mounting of Body Part 2

Figure 7:
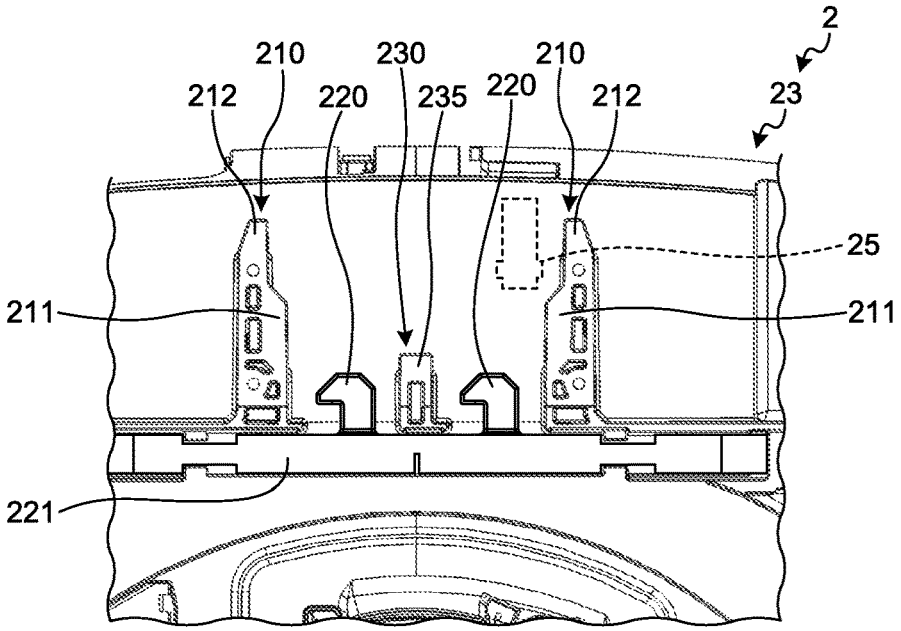
FIG. 7 is a schematic bottom view illustrating a configuration of a part subjected to mounting that is included in a body part.

Next, a configuration of a part subjected to mounting that is included in the body part 2 will be described with reference to FIG. 7 and FIG. 8. FIG. 7 is a schematic bottom view illustrating a configuration of a part subjected to mounting that is included in the body part 2 and FIG. 8 is a schematic perspective view illustrating a configuration of a part subjected to mounting that is included in the body part 2.

Figure 8:
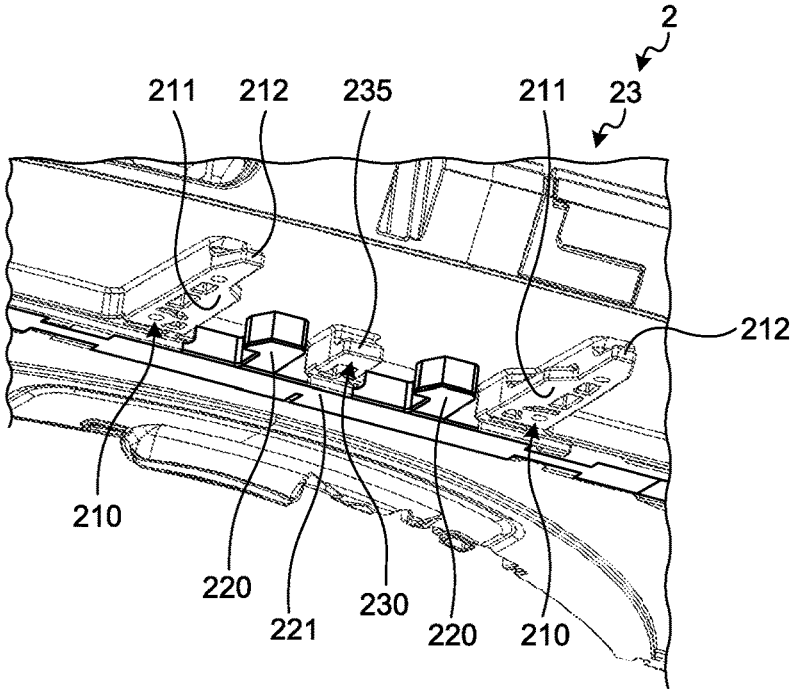
FIG. 8 is a schematic perspective view illustrating a configuration of a part subjected to mounting that is included in a body part.

As illustrated in FIG. 7 and FIG. 8, a pair of first linear protrusions 210, 210, a pair of hook parts 220, 220, and a second linear protrusion 230 as parts subjected to mounting are provided on bottom of the functional part 23 that is included in the body part 2.

The first linear protrusions 210, 210, the hook parts 220, 220, and the second linear protrusion 230 are provided so as to correspond to the linear grooves 320, 320, the hook-like grooves 330, 330, and the third engagement recess 331 of the base plate 3, respectively. Specifically, the pair of hook parts 220, 220 is provided between the pair of the first linear protrusions 210, 210, and the second linear protrusion 230 is provided between the pair of hook parts 220, 220.

First engagement protrusions 211, 211 that protrude laterally are formed on side surfaces of the pair of first linear protrusions 210, 210 and second engagement protrusions 212, 212 that protrude toward a tip side are formed on a tip thereof. Furthermore, a third engagement protrusion 235 that protrudes toward a tip side is formed on a tip of the second linear protrusion 230. The first engagement protrusions 211, 211, the second engagement protrusions 212, 212, and the third engagement protrusion 235 engage with the first engagement recesses 321, 321, the second engagement recesses 323, 323, and the third engagement recess 331 of the base plate 3, respectively.

The pair of hook parts 220, 220 is connected to a locking lever 221 that extends in leftward and rightward directions, and the locking lever 221 is constantly pushed in a rightward direction by a non-illustrated spring member. Herein, it is possible for a non-illustrated release button to release a push caused by a spring member.

As the body part 2 is slid from a front side of the toilet bowl 5 to a back side thereof, the hook parts 220, 220 contact the hook-like grooves 330, 330 of the base plate 3 and a spring member provided on the locking lever 221 is compressed, so that the hook parts 220, 220 move in a leftward or rightward direction and fit in the hook-like grooves 330, 330. Thereby, a positional shift of the body part 2 in a frontward or backward direction is prevented.

Furthermore, as the body part 2 is slid, a pair of the first linear protrusions 210, 210 fit in the pair of linear grooves 320, 320 of the base plate 3. Thereby, a positional shift of the body part 2 in a leftward or rightward direction is prevented. Furthermore, in such a case, backlash of the body part 2 is prevented by the press fit protrusions 322, 322.

Furthermore, as the pair of first linear protrusions 210, 210 fits in the pair of linear grooves 320, 320, the first engagement protrusions 211, 211 and the second engagement protrusions 212, 212 overlap with the first engagement recesses 321, 321 and the second engagement recesses 323, 323, respectively, in upward and downward directions. Furthermore, the third engagement protrusion 235 overlaps with the third engagement recess 331 in upward and downward directions. Thereby, upward detachment of the base plate 3 is prevented.

Herein, as described above, the second engagement recesses 323, 323 are provided on a back side of the plate body 30 (a back side in mounting directions) with respect to a center of the plate body 30 and the third engagement recess 331 is provided on a front side of the plate body 30 (a front side in mounting directions) with respect to the center of the plate body 30. Thereby, in a case where upward force from a back side of the plate body 30 is applied to the body part 2, such force is mainly received by the pair of second engagement recesses 323, 323, and in a case where upward force from a front side of the plate body 30 is applied to the body part 2, such force is mainly received by the third engagement recess 331. Therefore, it is possible to fix the body part 2 appropriately in a case where force from any one of a back side and a front side of the plate body 30 is applied to the body part 2.

Furthermore, as illustrated in FIG. 7, the functional part 23 includes a Hall IC 25 as an opening or closing detection sensor that detects opening or closing of the toilet lid 21 between the pair of first linear protrusions 210, 210. Thus, the Hall IC 25 and the magnet 33 (see FIG. 5) according to the present embodiment are arranged between the pair of mounting holes 31, 31 in a plan view. Therefore, it is possible for the sanitary washing apparatus 1 according to the present embodiment to effectively utilize a region around the pair of mounting holes 31, 31 as an empty space, as compared with a conventional sanitary washing apparatus where a Hall IC or a magnet is arranged around a pair of mounting holes.

4. Configuration of Mounting Hole and Positioning Plate

Meanwhile, a pitch of the pair of first through-holes 53, 53 is defined by a standard, where, for example, a first pitch (for example, a pitch of 140 mm) and a second pitch (for example, a pitch of 155 mm) greater than the first pitch are present. The base plate 3 according to an embodiment is formed to be capable of dealing with such two kinds of pitches. Such a point will be described.

Figure 9:
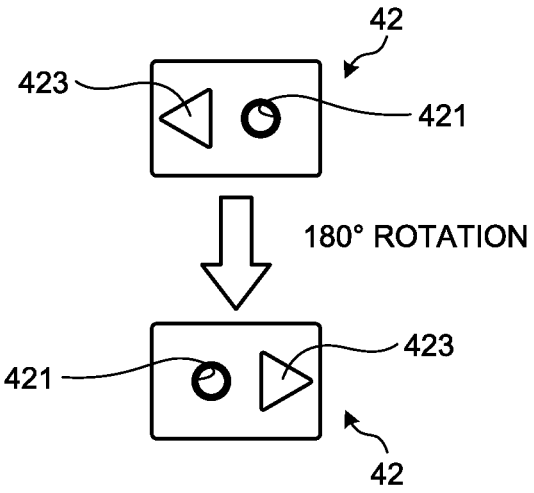
FIG. 9 is a schematic plan view illustrating a configuration of a positioning plate.

First, a configuration of the positioning plate 42 will be described with reference to FIG. 9. FIG. 9 is a schematic plan view illustrating a configuration of the positioning plate 42.

As illustrated in FIG. 9, the positioning plate 42 is a plate-like member with a rectangular shape that is longitudinal in leftward and rightward directions. The insertion hole 421 of the positioning plate 42 is formed at a position that shifts in leftward and rightward directions with respect to a center of the positioning plate 42.

Therefore, it is possible to change a position of the insertion hole 421 in the mounting hole 31 between a case where the positioning plate 42 is mounted in a first direction (for example, a direction where a triangular mark 423 is positioned outside the plate body 30) with respect to the mounting hole 31 and a case where the positioning plate 42 is mounted in a second direction (for example, a direction where the mark 423 is positioned on a center side of the plate body 30) provided by rotating the first direction by 180° (horizontal rotation).

Figure 10A:
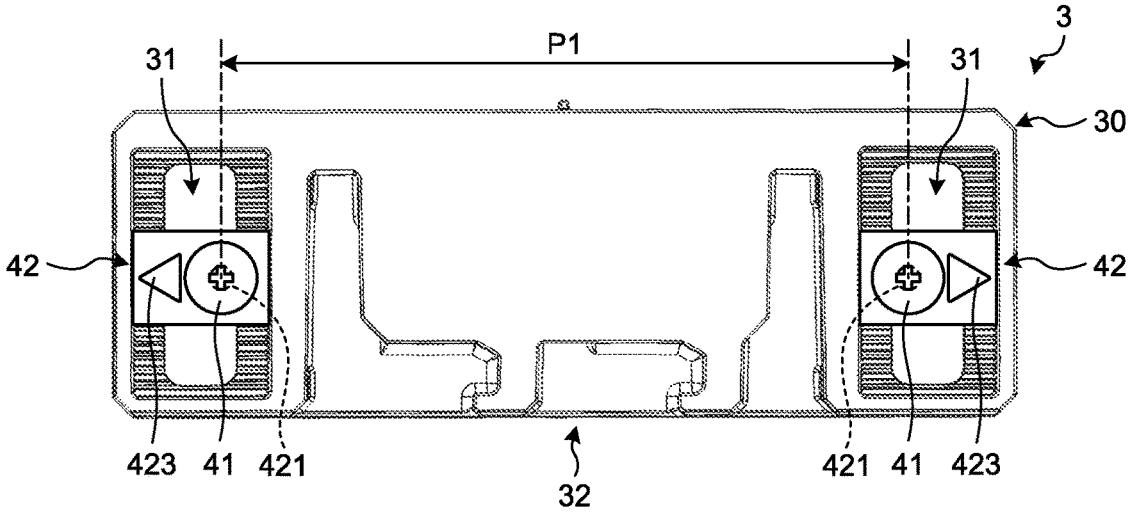
FIG. 10A is a schematic plan view of a base plate where a positioning plate is mounted on a mounting hole in a first direction.

FIG. 10A is a schematic plan view of the base plate 3 where the positioning plate 42 is mounted on the mounting hole 31 in a first direction. Furthermore, FIG. 10B is a schematic plan view of the base plate 3 where the positioning plate 42 is mounted on the mounting hole 31 in a second direction.

As illustrated in FIG. 10A, in a case where the positioning plate 42 is mounted on the mounting hole 31 in the first direction, positions of insertion holes 421, 421 of respective positioning plates 42, 42 correspond to positions of the first through-holes 53, 53 provided at a first pitch P1. In other words, a distance between the insertion holes 421, 421 is the first pitch P1.

Figure 10B:
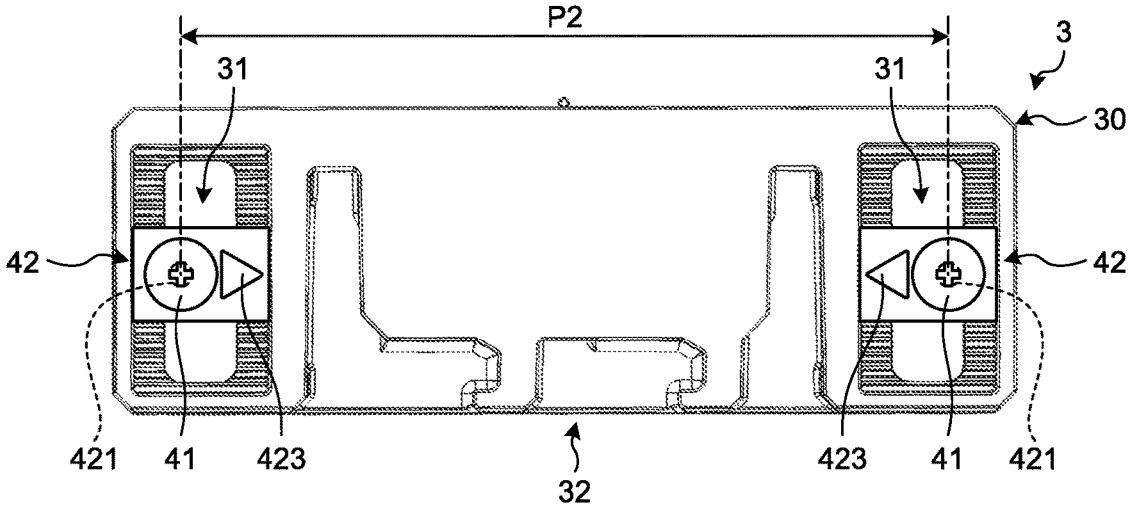
FIG. 10B is a schematic plan view of a base plate where a positioning plate is mounted on a mounting hole in a second direction.

On the other hand, as illustrated in FIG. 10B, in a case where the positioning plate 42 is mounted on the mounting hole 31 in the second direction, positions of insertion holes 421, 421 of respective positioning plates 42, 42 correspond to positions of the first through-holes 53, 53 provided at a second pitch P2. In other words, a distance between the insertion holes 421, 421 is the second pitch P2.

Figure 11A:
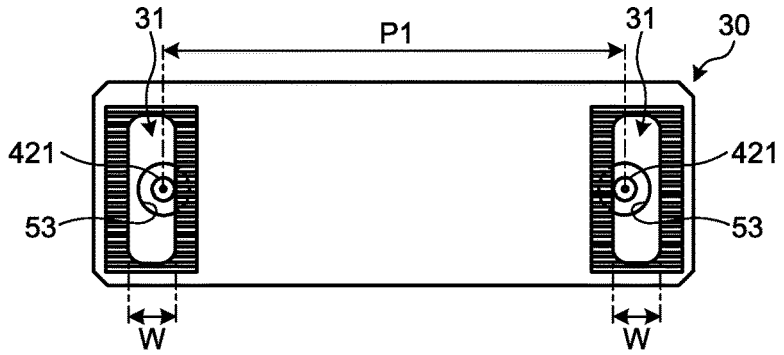
FIG. 11A is a schematic plan view illustrating a configuration of a pair of mounting holes.
Figure 11B:
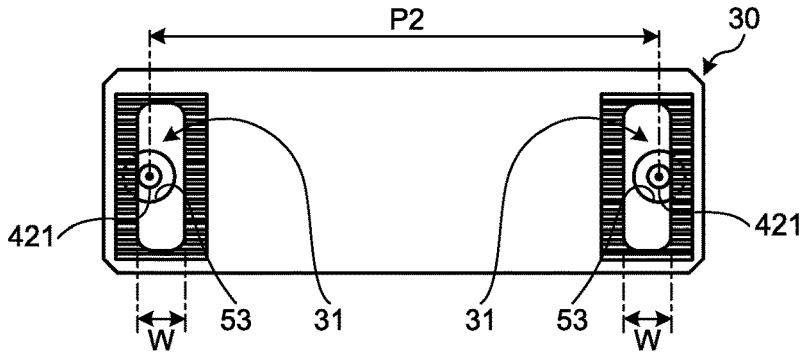
FIG. 11B is a schematic plan view illustrating a configuration of a pair of mounting holes.
Figure 11C:
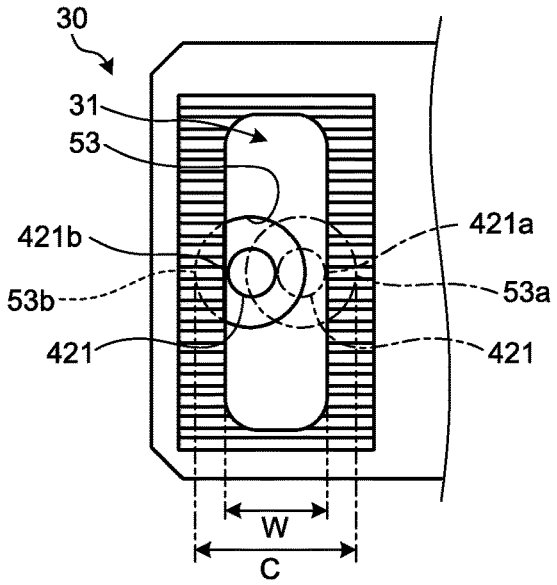
FIG. 11C is a schematic plan view illustrating a configuration of a pair of mounting holes.

Next, a specific structure of the pair of mounting holes 31, 31 will be described with reference to FIG. 11A to FIG. 11C. FIG. 11A to FIG. 11C are schematic plan views illustrating a configuration of the pair of mounting holes 31, 31. Herein, illustration of FIG. 11A to FIG. 11C appropriately omits a configuration other than the pair of mounting holes 31, 31 in order to facilitate understanding thereof.

As illustrated in FIG. 11A and FIG. 11B, the mounting hole 31 has a width W that communicates with the insertion hole 421 in any of a case where the positioning plate 42 is mounted on the mounting hole 31 in the first direction (see FIG. 10A) and a case where it is mounted in the second direction (see FIG. 10B).

Specifically, as illustrated in FIG. 11C, the width W of the mounting hole 31 in leftward and rightward directions is set to be greater than or equal to a relative distance between peripheral surfaces 421*a*, 421*b* of the insertion hole 421 of the positioning plate 42 mounted in the first direction (insertion hole 421 indicated by a dashed-dotted line in the figure) and the insertion hole 421 of the positioning plate 42 mounted in the second direction (insertion hole 421 indicated by a solid line in the figure) on mutually farthest sides.

Furthermore, the width W of the mounting hole 31 in leftward and rightward directions is set to be less than a relative distance C between peripheral surfaces 53*a*, 53*b* of the first through-hole 53 provided at the first pitch P1 and the first through-hole 53 provided at the second pitch P2 on mutually farthest sides (that is, W<C).

Thus, the base plate 3 according to an embodiment is capable of dealing with two kinds of pitches of the pair of first through-holes 53, 53. That is, it is possible to share the base plate 3 between the toilet bowl 5 where the pair of first through-holes 53, 53 is provided at the first pitch P1 and the toilet bowl 5 where the pair of first through-holes 53, 53 is provided at the second pitch P2. Therefore, it is possible to provide the sanitary washing apparatus 1 with high versatility.

5. Variation

Figure 12:
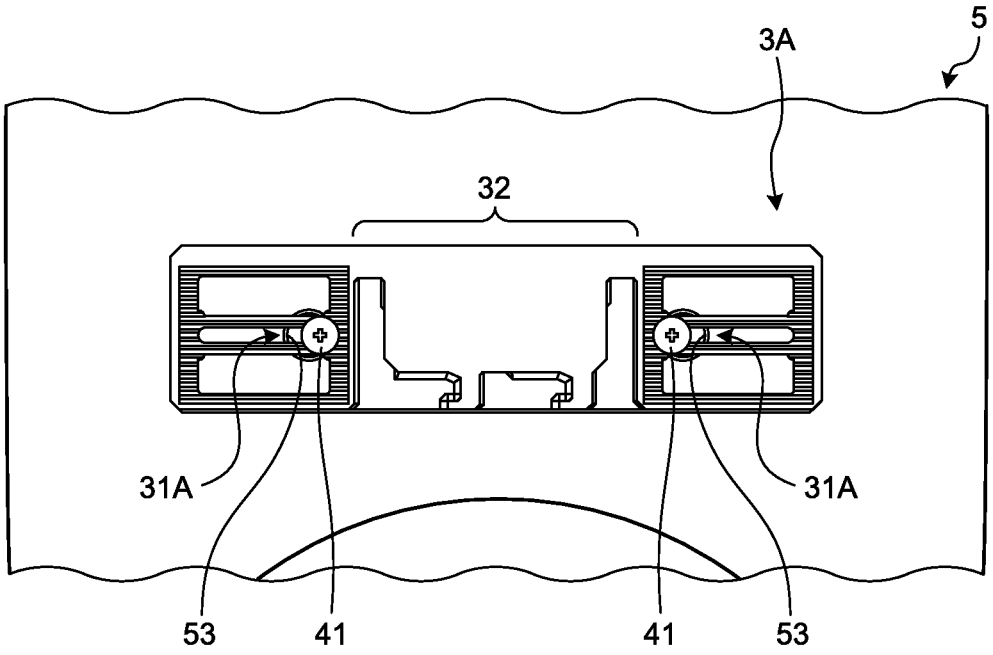
FIG. 12 is a schematic plan view illustrating a configuration of a base plate according to a variation.

Next, a variation of the base plate 3 according to an embodiment will be described with reference to FIG. 12. FIG. 12 is a schematic plan view illustrating a configuration of a base plate according to a variation. Additionally, in the following description, a part similar to a part having already been described will be provided with a symbol identical to that of the part having already been described to omit a redundant description thereof.

Although an example of a case where the base plate 3 includes the mounting holes 31, 31 capable of dealing with two kinds of pitches of the pair of first through-holes 53, 53 has been described in the embodiment as described above, a configuration of a mounting hole is not limited thereto. For example, a mounting hole may be configured to be capable of dealing with more kinds of toilets.

For example, as illustrated in FIG. 12, a base plate 3A according to a variation includes a plate body 30A, a pair of bolts 41, 41, a non-illustrated pair of first nuts 43, 43, a non-illustrated pair of bushes 44, 44, and a non-illustrated pair of second nuts 45, 45. The plate body 30A includes a pair of mounting holes 31A, 31A and the mounting part 32.

The mounting hole 31A extends in a longitudinal direction of the plate body 30A (a direction of sequence of a pair of mounting holes). A width of the mounting hole 31A in a transverse direction of the plate body 30A is greater than a diameter of a screw portion of the bolt 41 and less than a diameter of a screw head portion of the bolt 41.

The base plate 3A according to a variation is configured as described above and it is possible to move the bolt 41 along the mounting hole 31A in leftward and rightward directions. Then, it is possible for the non-illustrated first nut 43, bush 44, and second nut 45 to position the bolt 41 on the mounting hole 31A at an arbitrary location in leftward and rightward directions.

Therefore, it is possible for the base plate 3A according to a variation to execute mounting within a width of the mounting hole 31A, even for a toilet bowl that has a pitch other than the first pitch P1 and second pitch P2 as described above, as a pitch of a pair of first through-holes.

Herein, although the base plate 3A according to a variation has an opening on each of a front side and a back side of the mounting hole 31A, such an opening is not necessarily formed.

As described above, the sanitary washing apparatus 1 according to an embodiment includes the base plate 3, 3A and the body part 2. The base plate 3, 3A has the pair of mounting holes 31, 31 (31A, 31A) that correspond to the pair of first through-holes 53, 53 (an example of through-holes) formed on the upper surface 52 of the toilet bowl 5 and is mounted on the toilet bowl 5 by inserting the bolts 41, 41, the first nuts 43, 43, the bushes 44, 44, and the second nuts 45, 45 (an example of fastening members) mounted on the pair of mounting holes 31, 31 (31A, 31A) through the pair of first through-holes 53, 53. The body part 2 incorporates a functional component that includes the washing nozzle 231 and is mounted on the toilet bowl 5 via the base plate 3, 3A. Furthermore, the mounting part 32 for the body part 2 is formed only between the pair of mounting holes 31, 31 (31A, 31A) in the base plate 3, 3A.

Therefore, it is possible for the sanitary washing apparatus 1 according to an embodiment to secure strength of mounting on the toilet bowl 5. Furthermore, it is possible to reduce a length of the plate body 30, 30A in a longitudinal direction thereof, and hence, it is possible to pass the water supply hose 232 or the electrical power supply cord 233 through the second through-hole 54 without plugging the second through-hole 54 for passing the water supply hose 232 or the electrical power supply cord 233 therethrough.

A sanitary washing apparatus according to an aspect of an embodiment includes a base plate and a body part. The base plate has a pair of mounting holes that corresponds to a pair of through-holes formed on an upper surface of a toilet bowl and is mounted on the upper surface of the toilet bowl by inserting fastening members mounted on the pair of mounting holes through the pair of through-holes. The body part incorporates a functional component that includes a washing nozzle, and is mounted on the toilet bowl via the base plate. Furthermore, a mounting part for the body part is formed only between the pair of mounting holes on the base plate.

A mounting part is formed only between a pair of mounting holes, and hence, it is possible to secure strength of mounting on a toilet bowl, as compared with a conventional base plate where a mounting part is arranged close to an insertion hole opened in order to insert a water supply hose or an electrical power supply cord therethrough, around a pair of mounting holes. Furthermore, a mounting part is collective between a pair of mounting holes, so that it is possible to form a base plate so as to be compact as compared with a conventional product thereof. Therefore, in a case where a through-hole for passing a water supply hose or an electrical power supply cord therethrough is provided around a pair of through-holes of a toilet bowl, it is possible to pass through such a through-hole and hide the water supply hose or the electrical power supply cord, without plugging such a The body part is slid relative to the base plate and thereby mounted on the mounting part of the base plate. And the mounting part includes a pair of linear grooves and a pair of first engagement recesses. The pair of linear grooves extend in a mounting direction of the body part and open on a front side in the mounting direction and an upper side thereof. The pair of first engagement recesses are provided on side surfaces of the pair of linear grooves, open on a front side in the mounting direction and a side of the linear grooves, and are plugged on an upper side thereof.

A pair of linear grooves prevents a positional shift of a body part in a leftward or rightward direction and a first engagement recess prevents upward detachment of such a body part, so that it is possible to fix such a body part appropriately.

The mounting part includes a press fit protrusion that is provided on a side surface of the pair of linear grooves. Among both left and right side surfaces of the linear grooves, the first engagement recess is formed on a side surface on a center side of the base plate and the press fit protrusion is formed on a side surface on an outer side thereof.

It is possible for a press fit protrusion to prevent backlash of a body part. Furthermore, it is possible to form a mounting part so as to be compact as compared with a case where arrangement of a first engagement recess and a press fit protrusion is reversed, and hence, it is possible for a mounting part to be collective appropriately within a region between a pair of mounting parts.

The mounting part includes a pair of second engagement recesses that are provided on a surface of the pair of linear grooves on a back side in the mounting direction, open on a front side in the mounting direction, and are plugged on an upper side thereof.

A pair of second engagement recesses prevents upward detachment of a body part, so that it is possible to fix such a body part more appropriately.

The sanitary washing apparatus further comprising a third engagement recess that is formed between the pair of linear grooves, opens on a front side in the mounting direction, and is plugged on an upper side thereof. The pair of second engagement recesses is formed on a back side in the mounting direction with respect to a center of the base plate. The third engagement recess is formed on a front side in the mounting direction with respect to the center of the base plate.

In a case where upward force from a back side in a mounting direction is applied to a body part, such force is mainly received by a pair of second engagement recesses, or in a case where upward force from a front side in a mounting direction is applied to a body part, such force is mainly received by a third engagement recess. Therefore, in a case where force from any side among a back side and a front side in a mounting direction is applied to a body part, it is possible to fix such a body part appropriately.

The mounting part includes a pair of hook-like grooves formed between the pair of linear grooves. The third engagement recess is provided on a surface of one hook-like groove among the pair of hook-like grooves on a back side in the mounting direction.

A hook-like groove is arranged on a front side in a mounting direction and a third engagement recess is arranged on a back side, so that it is possible to form a mounting part so as to be more compact. Therefore, it is possible for a mounting part to be collective appropriately within a region between a pair of mounting parts.

The base plate includes a pair of bolts, and a pair of positioning plates that have insertion holes for the bolts at positions shifting from a center thereof and are mounted on the mounting holes, thereby positioning the bolts in the mounting holes. The pair of mounting holes has a width to communicate with the insertion holes in any case among a case where the positioning plates are mounted in a first direction with respect to the mounting holes and a case where it is mounted in a second direction provided by rotating the first direction by 180°.

Thereby, it is possible to mount a base plate on two kinds of toilet bowls with a pitch of a pair of through-holes being different, and hence, it is possible to provide a sanitary washing apparatus with high versatility.

According to an aspect of an embodiment, it is possible to provide a sanitary washing apparatus that is able to secure strength of mounting on a toilet bowl.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sanitary washing apparatus, comprising:

a toilet bowl with a pair of first through-holes and a second through-hole that are formed on an upper surface thereof;

a base plate that has a pair of mounting holes that corresponds to the pair of first through-holes and is mounted on the upper surface of the toilet bowl by inserting fastening members mounted on the pair of mounting holes through the pair of first through-holes; and a body part that incorporates a functional component that includes a washing nozzle, and is mounted on the toilet bowl via the base plate, wherein the second through-hole is a through-hole for passing a water supply hose and an electrical power supply cord that are connected to the body part and is arranged around the pair of first through-holes, a mounting part for the body part is formed only between the pair of mounting holes on the base plate and the base plate does not plug the second through-hole.

2. The sanitary washing apparatus according to claim 1, wherein the body part is slid relative to the base plate and thereby mounted on the mounting part of the base plate, and the mounting part includes:

a pair of linear grooves that extend in a mounting direction of the body part and open on a front side in the mounting direction and an upper side thereof; and a pair of first engagement recesses that are provided on side surfaces of the pair of linear grooves, open on a front side in the mounting direction and a side of the linear grooves, and are plugged on an upper side thereof.

3. The sanitary washing apparatus according to claim 2, wherein the mounting part includes a press fit protrusion that is provided on a side surface of the pair of linear grooves, and among both left and right side surfaces of the linear grooves, the first engagement recess is formed on a side surface on a center side of the base plate and the press fit protrusion is formed on a side surface on an outer side thereof.

4. The sanitary washing apparatus according to claim 2, wherein the mounting part includes a pair of second engagement recesses that are provided on a surface of the pair of linear grooves on a back side in the mounting direction, open on a front side in the mounting direction, and are plugged on an upper side thereof.

5. The sanitary washing apparatus according to claim 4, further comprising:

a third engagement recess that is formed between the pair of linear grooves, opens on a front side in the mounting direction, and is plugged on an upper side thereof, wherein the pair of second engagement recesses is formed on a back side in the mounting direction with respect to a center of the base plate, and the third engagement recess is formed on a front side in the mounting direction with respect to the center of the base plate.

6. The sanitary washing apparatus according to claim 5, wherein the mounting part includes a pair of hook-like grooves formed between the pair of linear grooves, and the third engagement recess is provided on a surface of one hook-like groove among the pair of hook-like grooves on a back side in the mounting direction.

7. The sanitary washing apparatus according to claim 1, wherein the base plate includes a pair of bolts, and a pair of positioning plates that have insertion holes for the bolts at positions shifting from a center thereof and are mounted on the mounting holes, thereby positioning the bolts in the mounting holes, the pair of mounting holes has a width to communicate with the insertion holes in any case among a case where the positioning plates are mounted in a first direction with respect to the mounting holes and a case where it is mounted in a second direction provided by rotating the first direction by 180°.

* * * * *